US011317698B1

(12) United States Patent
Wise

(10) Patent No.: US 11,317,698 B1
(45) Date of Patent: May 3, 2022

(54) REPEATEDLY REFILLABLE REUSABLE DISPENSER

(71) Applicant: Robert Wise, Penngrove, CA (US)

(72) Inventor: Robert Wise, Penngrove, CA (US)

( * ) Notice: Subject to any disclaimer, the term of this patent is extended or adjusted under 35 U.S.C. 154(b) by 157 days.

(21) Appl. No.: 16/855,361

(22) Filed: Apr. 22, 2020

Related U.S. Application Data

(63) Continuation-in-part of application No. 16/683,689, filed on Nov. 14, 2019.

(51) Int. Cl.
*A45D 40/26* (2006.01)
*A45D 40/06* (2006.01)

(52) U.S. Cl.
CPC ..... *A45D 40/261* (2013.01); *A45D 40/06* (2013.01)

(58) Field of Classification Search
CPC ..... A45D 40/261; A45D 40/06; A45D 40/04; A45D 2040/0043; A45D 2040/005; A45D 40/16; A45D 2040/204; A45D 2034/005; B65D 83/0022
See application file for complete search history.

(56) References Cited

U.S. PATENT DOCUMENTS 1,863,106 A * 6/1932 Gimonet ..... A45D 40/04 401/173
1,904,364 A * 4/1933 Fullmer ..... A45D 40/023 401/60
2,471,852 A * 5/1949 Bau ..... A45D 40/0075 222/95
2,632,193 A * 3/1953 Gilchrist ..... A45D 34/041 401/180
3,212,120 A * 10/1965 Gentile ..... A45D 40/04 401/175
4,277,194 A * 7/1981 Smith ..... A46B 11/0027 222/326
4,388,011 A * 6/1983 Smith ..... A46B 11/0027 132/308
4,932,802 A * 6/1990 Cantone ..... A45D 29/007 401/126
5,505,041 A * 4/1996 Harlan ..... A45D 40/04 206/385
5,829,976 A * 11/1998 Green ..... A61C 15/00 433/89
11,109,658 B1 * 9/2021 Khodzhayan ..... A45D 34/041
2006/0065673 A1 * 3/2006 Miyazaki ..... B65D 51/20 222/96
2008/0107475 A1 * 5/2008 Wojcik ..... A45D 40/261 401/216
2014/0286689 A1 * 9/2014 Jung ..... B05B 11/0054 401/179
2018/0249808 A1 * 9/2018 Crawford ..... A45D 40/04
2018/0249809 A1 * 9/2018 Crawford ..... A45D 40/02
2018/0295968 A1 * 10/2018 Groffsky ..... B65D 83/0038
2021/0137243 A1 * 5/2021 Nolan ..... A45D 40/16

* cited by examiner

*Primary Examiner* — Patrick M. Buechner
(74) *Attorney, Agent, or Firm* — Boudwin Intellectual Property; Daniel Boudwin

(57) ABSTRACT

A roll-on dispenser includes a housing having a base, an open top end, and an interior volume. The interior volume of the housing has a rising device coupled to the base of the housing. The rising device is in turn coupled to a cartridge riser plate. The opened top end of the housing has a top section which can be removably secured. The top section also houses a roller ball therein.

20 Claims, 9 Drawing Sheets

REPEATEDLY REFILLABLE REUSABLE DISPENSER

CROSS REFERENCE TO RELATED APPLICATIONS

This application claims the benefit of U.S. patent application Ser. No. 16/683,689 filed on Nov. 14, 2019. The above identified patent application is herein incorporated by reference in its entirety to provide continuity of disclosure.

BACKGROUND OF THE INVENTION

The present invention relates to a dispenser housing. More particularly, the present invention provides a housing that has is adapted to accept refill cartridges.

A large number of humans use deodorant, or similar spreadable substances every day. These substances often come in plastic canisters. These canisters are meant to be used once then tossed aside. While these canisters are functional and inexpensive, they also create waste.

Plastic takes decades to decompose and all the while takes space in landfills. The trash issue in our planet is starting to reach critical levels as more and more things are made to be disposable. Items such as canisters take up even more room due to the nature of having the canister having an interior volume to hold a solution which is dispensed through the usage of the consumable product. Due to the number of canisters used these items account for a significant amount of landfill.

Consequently, there is a need in for an improvement in the art of dispenser housings in order to provide for waste reduction. The present invention substantially diverges in design elements from the known art while at the same time solves a problem many people face when using dispensers to apply substances to a desired surface, such as an individual's body. In this regard the present invention substantially fulfills these needs.

SUMMARY OF THE INVENTION

The present invention provides a refillable dispenser housing. wherein the same can be utilized for providing convenience for the user when using dispensers to apply substances to a desired surface. The repeatedly refillable reusable dispenser comprises a dispenser housing having a sidewall, a base and an open top end. A cap is removably secured to the open top end of the housing. The cap has a plurality of apertures located therein. The side wall has an aperture located therethrough. A movable dispenser base is disposed within the housing, wherein the movable dispenser base creates a seal with the sidewall. A screw rod is secured within the housing and has a knob attached. The knob will rotate the screw rod when turned. The screw rod and the knob are rotatably attached within the dispenser housing such that the knob protrudes through the aperture. A scissor lift is attached to the screw rod at a first pair of ends. The scissor lift is attached to the movable dispenser base at a second pair of ends.

Another object of the repeatedly refillable reusable dispenser is to have a lid, where the lid is configured to be placed upon the open top end of the dispenser housing.

Another object of the repeatedly refillable reusable dispenser is to have the first pair of ends of the scissor lift have a pair of threaded apertures configured to attach to the screw rod.

Another object of the repeatedly refillable reusable dispenser is to have the second pair of ends of the scissor lift have an attachment device located thereon, wherein the attachment device attaches to the movable dispenser base.

Another object of the repeatedly refillable reusable dispenser is to have the movable dispenser base have a pair of attachment apertures located on a bottom side thereof.

Another object of the repeatedly refillable reusable dispenser is to have the attachment apertures be elongated apertures, such that the attachment devices located on the scissor lift are slidably connected to the attachment apertures.

Another object of the repeatedly refillable reusable dispenser is to have a disposable cartridge filled with deodorant.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
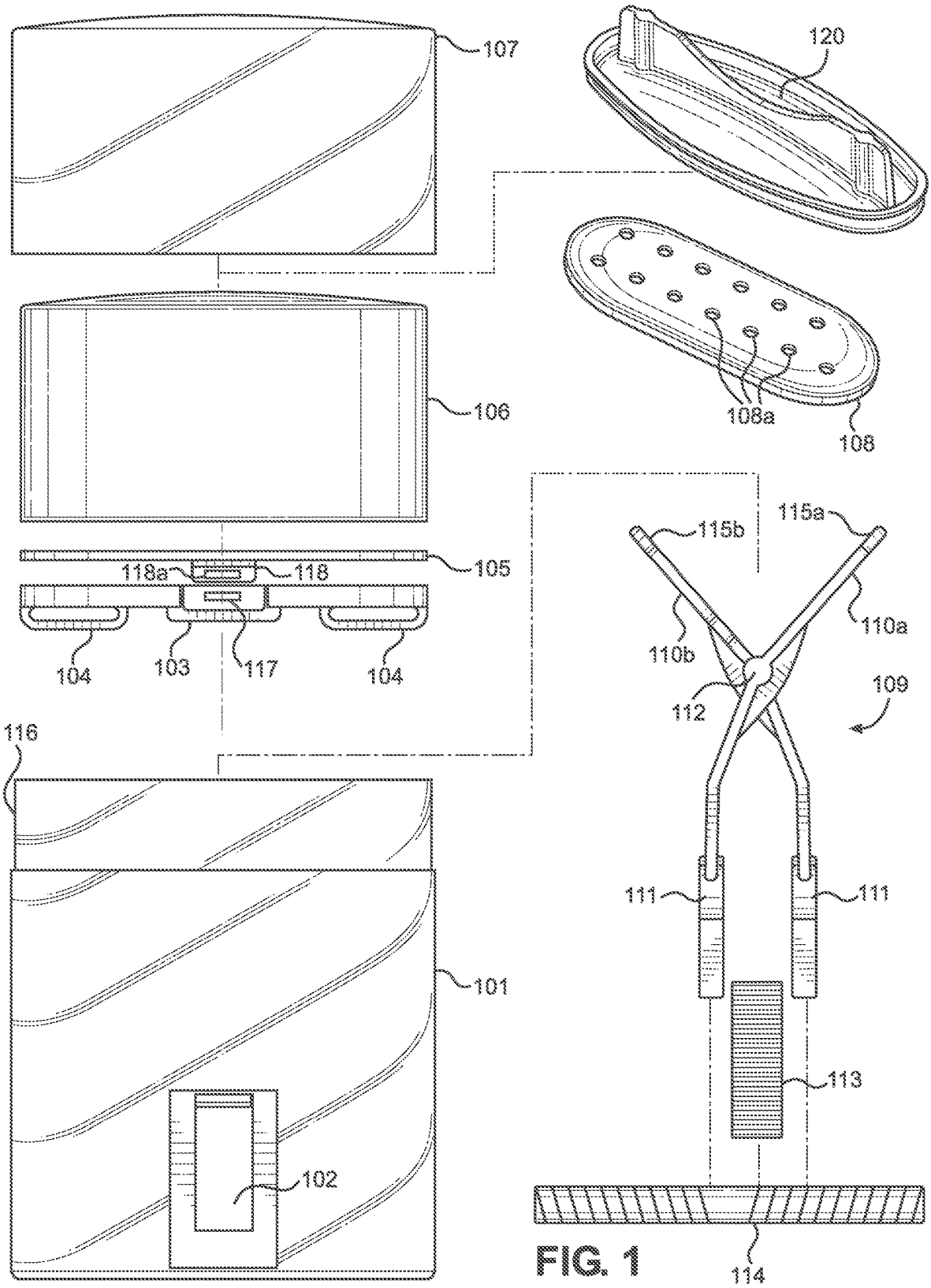
FIG. 1 shows an exploded view of an embodiment of the repeatedly refillable reusable dispenser.

Reference is made herein to the attached drawings. Like reference numerals are used throughout the drawings to depict like or similar elements of the refillable dispenser housing. For the purposes of presenting a brief and clear description of the present invention, a preferred embodiment will be discussed as used for the refillable dispenser housing. The figures are intended for representative purposes only and should not be considered to be limiting in any respect.

Referring now to FIG. 1, there is shown an exploded view of an embodiment of the repeatedly refillable reusable dispenser. The refillable dispenser housing includes a housing 101. The housing has a base, a sidewall and an open top end. The sidewall has an aperture 102 located therethrough. In one embodiment, there is a first aperture 102 located through the sidewall on one side and a second aperture is located on the sidewall opposite the first aperture and in alignment therewith. In one embodiment, the sidewall is configured to have a lip 116 located about a top end. The lip 116 is configured to accept a lid 107 thereon. The lid 107 is configured to have a friction fit.

In one embodiment, there is a cap 108 configured to fit within the open top end. The cap is configured to be removably placed within the open top end. In the illustrated embodiment, the cap 108 has a lip placed there around. The lip will prevent the cap from being placed too far into the housing 101. The cap 108 has a plurality of apertures 108*a* located therethrough. The plurality of apertures 108*a* will allow gel substances to be pushed therethrough. The cap 108 has a smooth upper surface. In one embodiment, the cap 108 has a rounded arch shape. This shape will better conform to and spread deodorant to an underarm.

In one embodiment there is further a freshness sealing cap 120. The freshness sealing cap 120 is configured to be placed on the top of the container 101. In one embodiment the freshness sealing cap is made from polyvinyl alcohol. This will allow the freshness sealing cap 120 to be biodegradable and disposable. The freshness sealing cap 120 will keep the spreadable substance fresh for an extended period of time.

The interior of the housing 101 contains a movable dispenser base 103. The movable dispenser base 103 is shaped to movably fit within the housing 101. The movable dispenser base 103 has a top side and a bottom side. The bottom side of the movable dispenser base 103 has a pair of attachment apertures 104. In one embodiment the attachment apertures 104 are elongated apertures. This will allow the attachment device 115*a*, 115*b* (described below) to slide horizontally within the apertures. This will better enable the scissor lift 109 (described below) to rise and lower.

The top side of the movable dispenser base 103 is configured to fit a substance attachment clip 105. In one embodiment, the substance attachment clip 105 is made from a biodegradable substance. In a further embodiment the substance is formed polyvinyl alcohol. In another embodiment the substance is paper covered in polyvinyl alcohol. In one embodiment the substance attachment clip 105 is dissolvable in an aqueous media. This will allow the attachment clip to eliminate space in landfills.

The movable dispenser base 103 has a protruding pin 117 located on at least one side thereof. The protruding pin 117 is configured to fit within an aperture 118*a* located on a tongue 118 attached to the substance attachment clip 105. In one embodiment the substance attachment clip 105 creates a waterproof seal with the sides of the housing 101. This will prevent gel substances from leaking into the housing below the movable dispenser base 103. In one embodiment the substance attachment clip 105 is configured to removably attach to the top side of the movable dispenser base 103.

The interior of the housing 101 further contains a scissor lift 109. The scissor lift 109 is comprised of a first side 110*a* and a second side 110*b*. The first side 110*a* and the second side 110*b* are attached with a rotating pin device 112. This device will allow the first side 110*a* and the second side 110*b* to rotate. The scissor lift 109 has an attachment device 115*a*, 115*b*. The attachment device is configured to slidably connect to the attachment apertures of the movable dispenser base 103. In one embodiment the attachment device 115*a*, 115*b* is a hook. At the opposite end of each side 110*a*, 110*b* there is an attachment 111 located at the bottom of each side 110*a*, 110*b*. In one embodiment the attachment 111 has a threaded portion.

The threaded portion within the attachment 111 is configured to attach to a screw rod 114. The screw rod 114 has threads located thereon. The threads are configured such that when the screw rod 114 is rotated, both attachments 111 will move towards each other; or away from each other respectively. In this manner, the scissor lift 109 will extend or collapse. In one embodiment the threads are configured to move the scissor lift in a large amount with only a small turn. For example, in one embodiment, one full rotation of the screw rod 114 will move the scissor lift 109 halfway into the extend position from fully collapsed. The screw rod 114 has a knob 113 attached. The knob 113 is configured to be wider that the screw rod 114. In one embodiment the knob 113 has a texture located around the outer edge. The texture will make the knob easier to turn.

The refillable dispenser is configured to hold a spreadable substance 106. In one embodiment, the spreadable substance 106 is a solid substance. In another embodiment, the spreadable substance 106 is wrapped in a biodegradable container. The container is removed and the spreadable substance 106 is inserted into the housing. In one embodiment the spreadable substance 106 is attached to the movable dispenser base 103 using a substance attachment clip 105.

In some embodiments the spreadable substance 106 is a gel substance. In this embodiment, the gel substance is located within a removable cartridge. In one embodiment the cartridge is a biodegradable cartridge. In one embodiment the cartridge is dissolvable in an aqueous media. In some embodiments that cartridge is a collapsible cartridge. This will allow for a gel substance to remain in the cartridge and be squeezed therefrom. In another embodiment the cartridges is designed to be removed from a solid spreadable substance and only the substance is placed in the housing 101. The cartridge is placed within the house 101 by attaching the attachment clip 105 to the movable dispenser base 103. The cap 108 is then attached to the open top end of the housing 101. As the spreadable substance 106 is pushed up and out of the cap 108 the cartridge will collapse.

Figure 2:
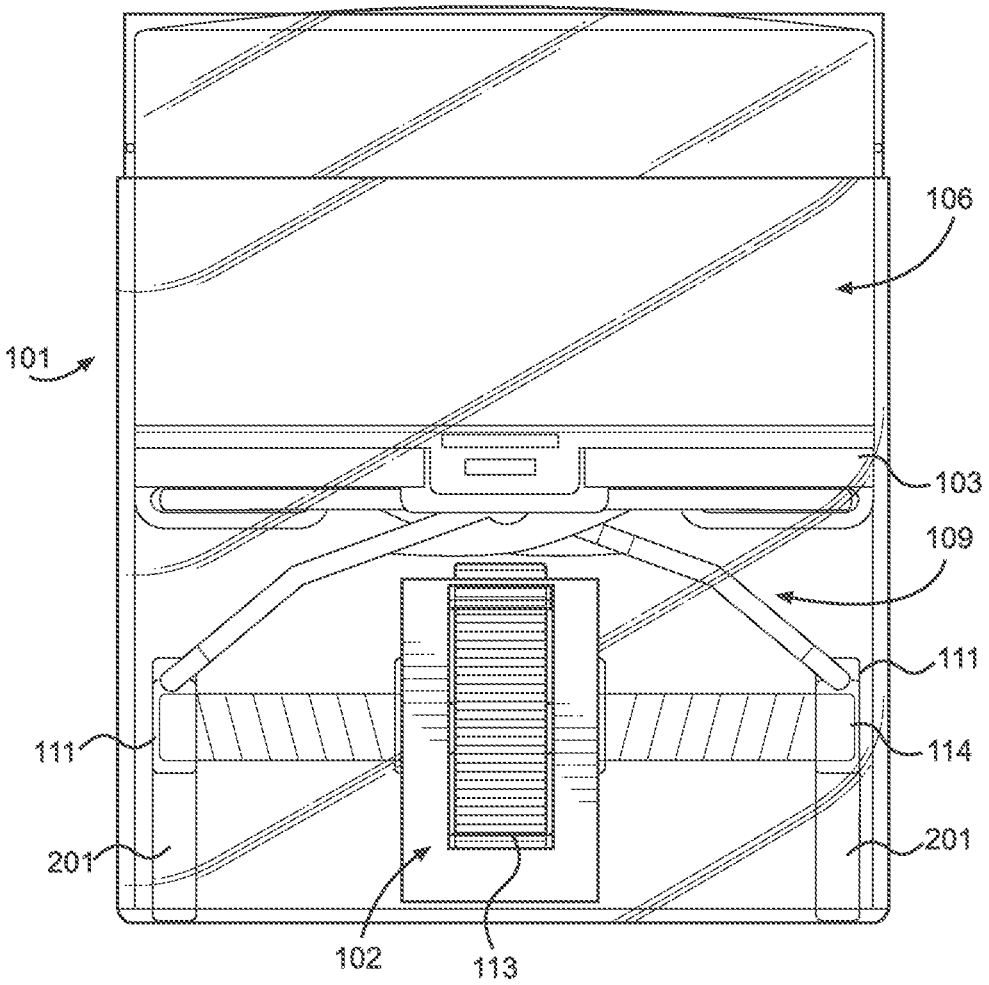
FIG. 2 shows a front view of an embodiment of the repeatedly refillable reusable dispenser in a collapsed position.

Referring now to FIG. 2, there is shown a front view of an embodiment of the repeatedly refillable reusable dispenser in a collapsed position. In the collapsed position, the scissor lift 109 is flattened such that it rests directly over the knob 113. In this position the scissor lift 109 will be at the outer edge of the screw rod 114. The movable dispenser base 103 will be lowered into the housing 101. The spreadable substance 106 will be positioned such that it is fully encapsulated within the housing 101.

In one embodiment the threaded attachment 111 has an elongated member 201 attached to a lower part thereof. The elongated member 201 is configured to allow the threaded attachment 111 to still attach to the screw rod 114. This is due to the fact that the elongated member 201 is located below the threaded attachment 111. The elongated member 201 is long enough that it will reach the bottom of the housing 101. This will take the weight of the spreadable substance 106 away from the scissor lift 109. The weight from the spreadable substance 106 will be displaced to the bottom of the housing 101.

Figure 3:
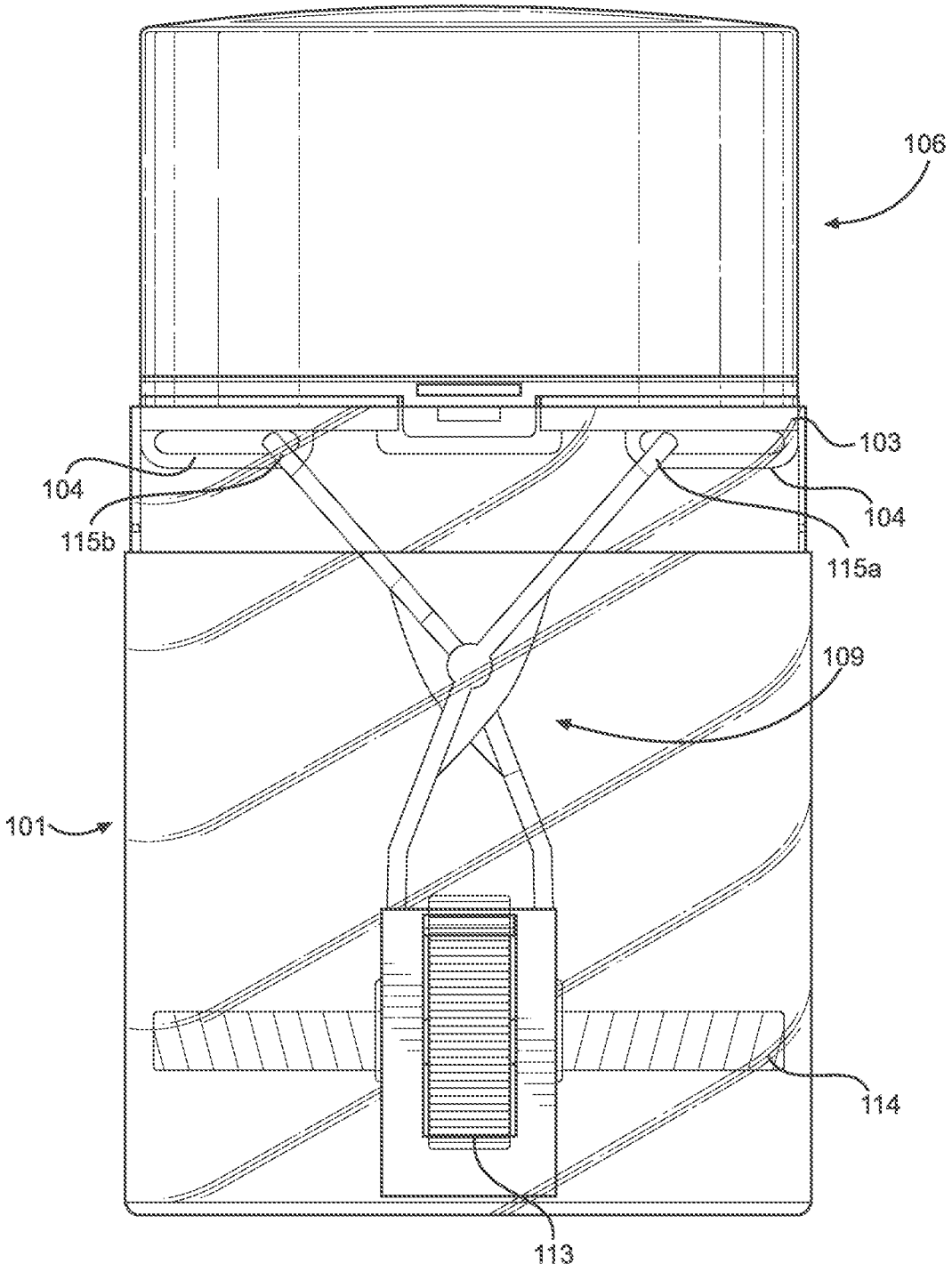
FIG. 3 shows a front view of an embodiment of the repeatedly refillable reusable dispenser in an expanded position.

Referring now to FIG. 3, there is shown a front view of an embodiment of the repeatedly refillable reusable dispenser in an expanded position. In the expanded position the scissor lift 109 is in an extended position. As the movable dispenser base 103 is lifted by the scissor lift 109 the attachment device 115*a*, 115*b* will slide within the connection apertures 104. As the scissor lift 109 is pulled closer to the knob on the screw rod 114, the scissor lift 109 will force the movable dispenser base 103 upward. This will push the spreadable substance 106 out of the open top end of the housing 101.

Figure 4:
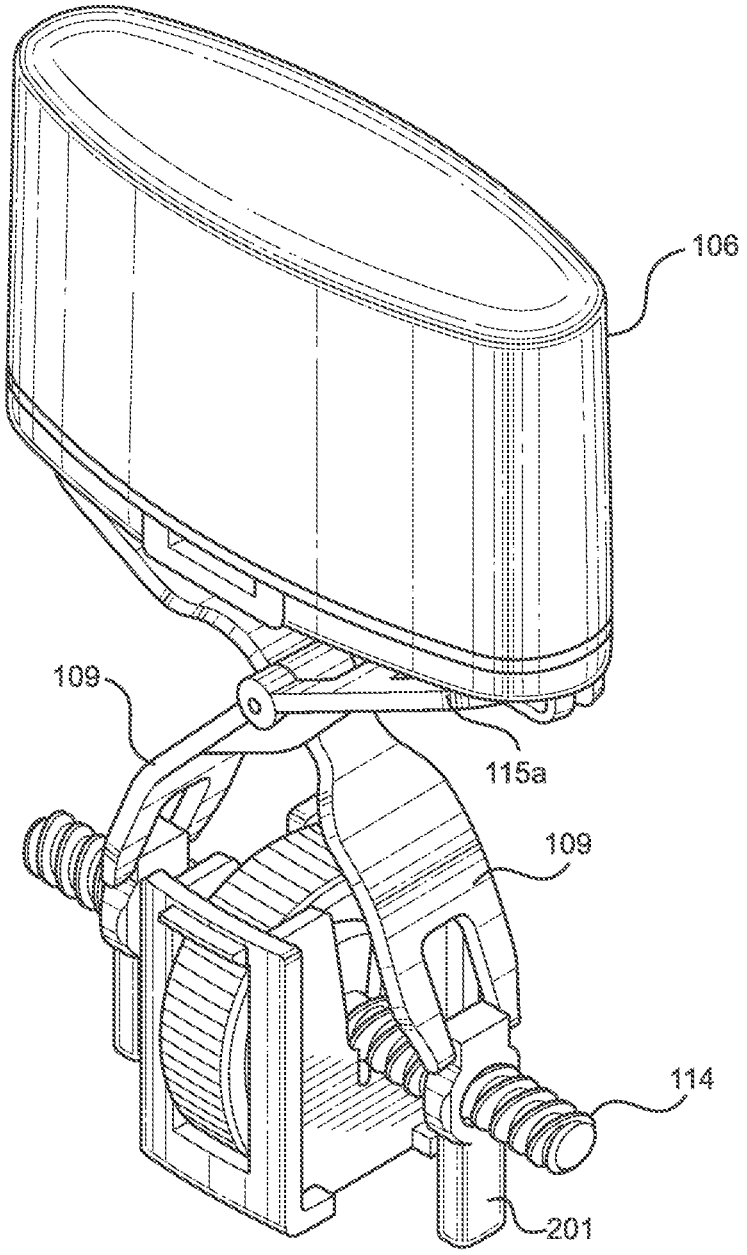
FIG. 4 shows a perspective view of an embodiment of the mechanism designed be placed within the housing.

Referring now to FIG. 4, there is shown a perspective view of an embodiment of the mechanism designed be placed within the housing. In the shown embodiment, the screw rod 114 is shown to have coarse or large threads. These threads will allow for the scissor lift 109 to be moved a large amount with a small turn. Further, there is shown a side view of the elongated member 201. The elongated member 201 is configured to be large enough to take the weight from the spreadable substance 106. In the shown embodiment the scissor lift 109 has a wide flat first side 110*a* and second side 110*b*.

Figure 5:
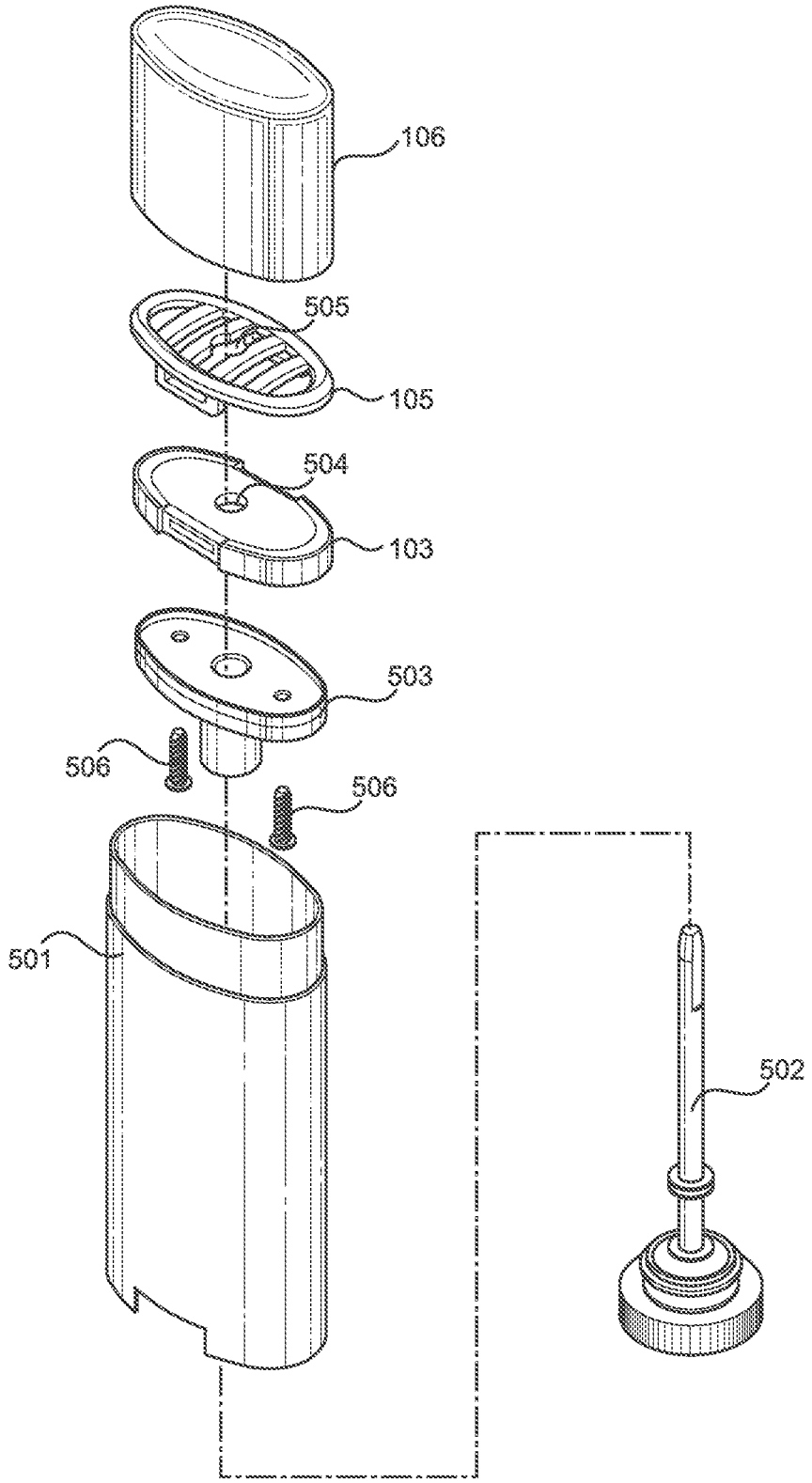
FIG. 5 shows an exploded view of an embodiment of a dispensing mechanism designed to work with an existing container.

Referring now to FIG. 5, there is shown an exploded view of an embodiment of a dispensing mechanism designed to work with an existing container. The existing container 501 has an existing vertical screw rod 502. The vertical screw rod 502 is configured to rise and lower an existing base 503. In this embodiment the movable base 103 is configured to attach to the existing base 503. In the shown embodiment the existing base 503 and the movable base 103 are attached using screws 506. In another embodiment other securement devices may be used.

In the shown embodiment the movable base 103 is configured to have an aperture 504 placed in the middle thereof. The aperture 504 is configured to allow the vertical screw rod 502 to be placed therethrough. Further, the attachment clip 105 is configured to have an aperture 505 placed therethrough. The aperture 505 is configured to have the vertical screw rod 502 placed therethrough. In this embodiment the spreadable substance 106 is able to be replaced as needed, without replacing the entire container.

Figure 6:
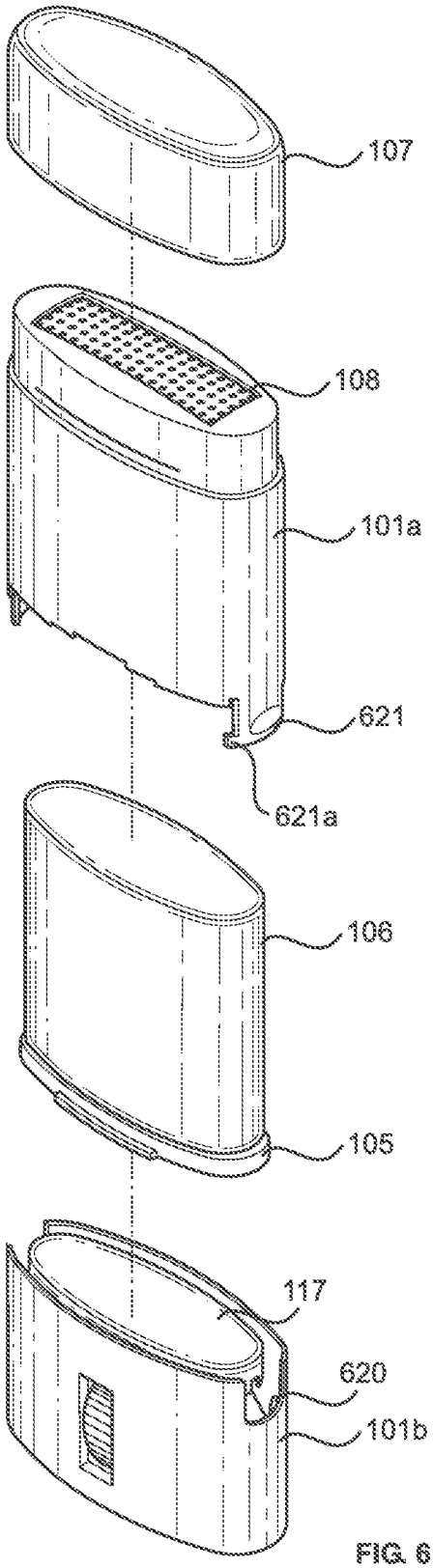
FIG. 6 shows an exploded view of an alternate embodiment of the repeatedly refillable reusable dispenser.

Referring now to FIG. 6, there is shown an exploded view of an alternate embodiment of the repeatedly refillable reusable dispenser. In the shown embodiment the housing can be separated into two sections, an upper section 101*a* and a lower section 101*b*. The lower section of the housing 101*b* houses a scissor lift and parts associated with the scissor lift. The scissor lift can then be attached to the attachment clip 105 of the spreadable substance cartridge via a corresponding fastener 117. The upper section of the housing 101*a* is removably securable to the lower section of the housing 101*b*. The upper section of the housing 101*a* has a pair of securement members 621 that will secure the upper section of the housing 101*a* to the lower section of the housing 101*b*. In one embodiment the securement happens by by mating the securement members 621 to interior notches 620 located within the lower section of the housing 101*b*. The securement member 621 have protrusions 621*a* that will fit within the interior notches 621*a* holding the upper section 101*a* to the lower section 101*b*.

In the shown embodiment, a cap 108 is secured to the upper section of the housing 101*a*, as previously described in relation to FIG. 1, above. The lid 107 can removably secure to the upper section of the housing 101*a* as previously described in FIG. 1, above.

Figure 7:
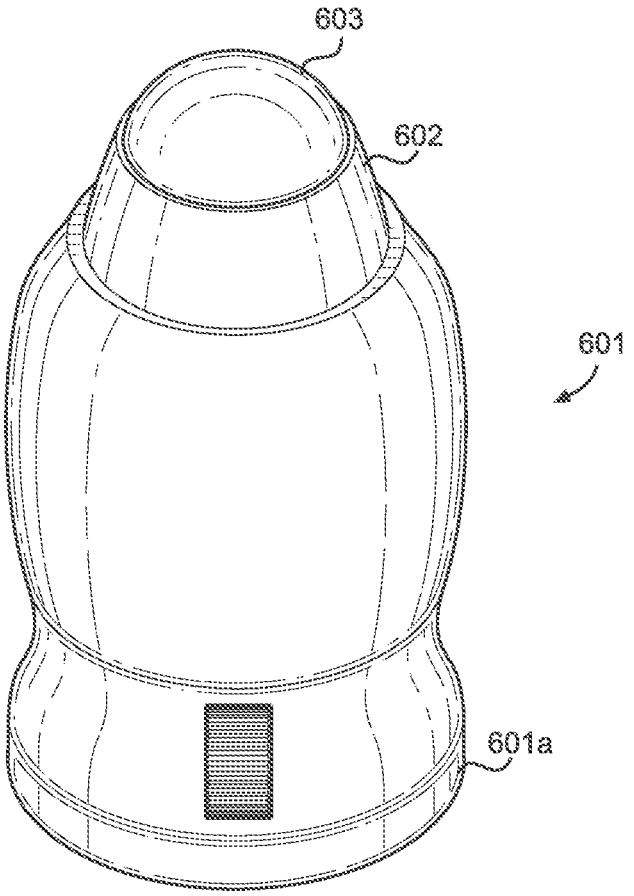
FIG. 7 shows a perspective view of an alternate embodiment of the repeatedly refillable reusable dispenser having a roll-on applicator.

Referring now to FIG. 7, there is shown a perspective view of an alternate embodiment of the repeatedly refillable reusable dispenser having a roll-on applicator. The roll-on dispenser is comprised of a housing 601 which includes a base 601*a* and an open upper end, which can be seen in FIG. 8. The housing 601 has an interior volume adapted to receive parts of the dispenser. In one embodiment the housing 601 is made from plastic.

In one embodiment the housing 601 has an ergonomic shape. In the shown embodiment, the housing 601 has a wider base 601*a* which narrows toward the middle of the housing 601. The housing 601 then widens again toward the open upper end. This will allow the housing 601 to be easily grasped by a user.

The open upper end of the housing 601 is removably attached to an upper section 602. The upper section 602 narrows further towards an opening. The opening houses a roller ball 603. The roller ball 603 will work with interior components to spread a substance onto a user as desired. In one embodiment, the roller ball 603 partially protrudes from the upper section 602.

Figure 8:
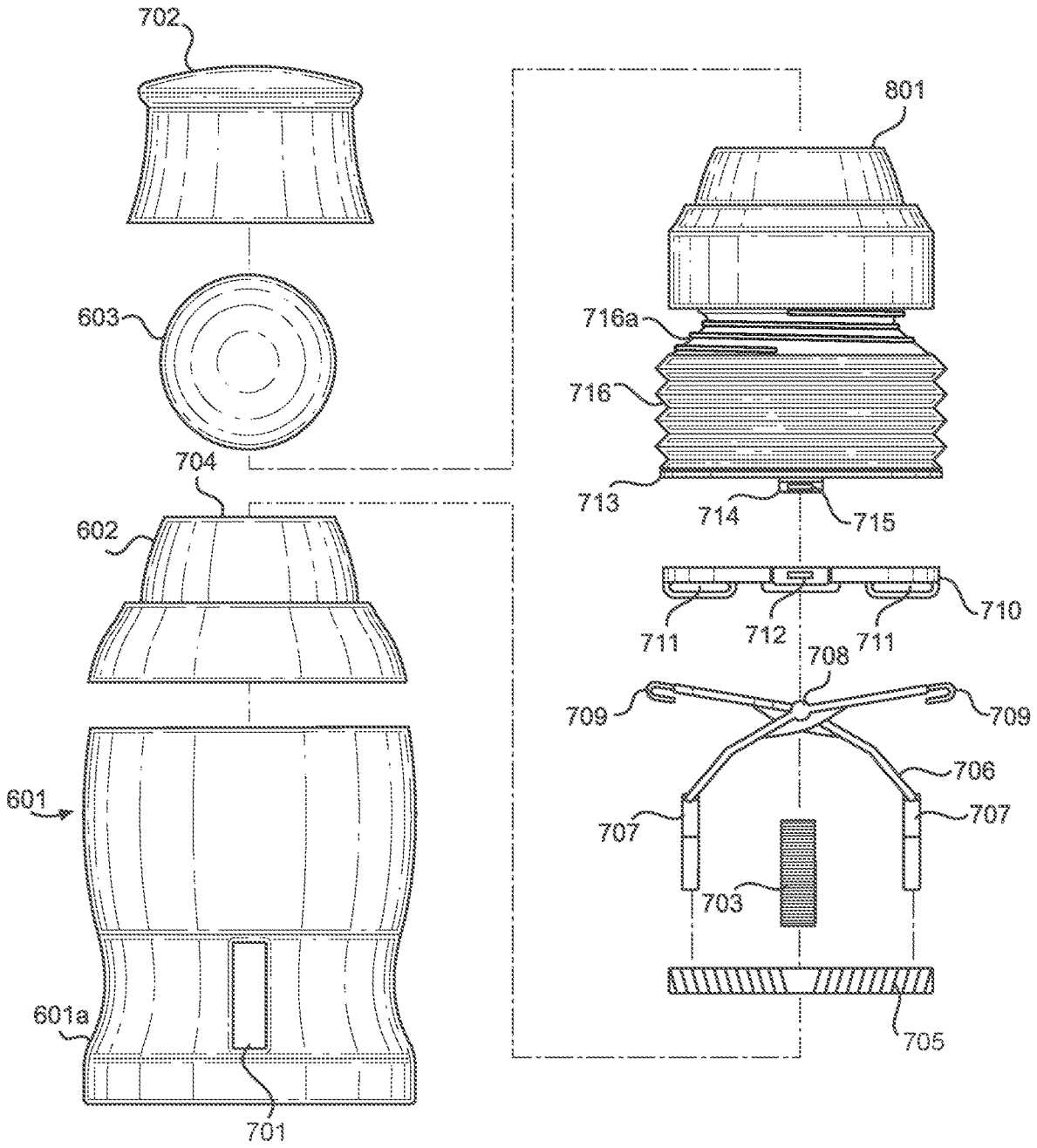
FIG. 8 shows an exploded view of an alternate embodiment of the repeatedly refillable reusable dispenser having a roll on applicator.

Referring now to FIG. 8, there is shown an exploded view of an alternate embodiment of the repeatedly refillable reusable dispenser having a roll on applicator. The housing 601 has an aperture 701 located near the base 601*a*. The aperture 701 is proportioned to fit a portion of a turn knob 703 which is part of the dispensing device. The housing 601 further includes a lid 702. The lid 702 is configured to removably attach to the upper section 602 and is contoured to cover portion of the roller ball 603 which will be protruding when the device is put together. In one embodiment the lid 702 snaps to the housing 601 and is frictionally held in place. In another embodiment the housing 601 will have threading thereon. The interior of the lid 702 will have threads therein. The lid 702 will be threaded onto the housing 601 to be held in place.

In the shown embodiment, the upper section 602 does not include the roller ball 603 therein. In one embodiment the upper section 602 is snap fit to the housing 601. In another embodiment the upper section 602 is threaded on to the housing 601. In the shown embodiment the upper section will fit flush with the housing 601 such that there is smooth connection. The opening 704 of the upper section 602 is proportioned such that the diameter of the roller ball is smaller than the opening 704. This will ensure that the roller ball cannot fall from the upper section 602.

The interior of the housing 601 holds a dispensing device. The dispensing device is comprised of a threaded rod 705. In one embodiment the threading on threaded rod 705 is a coarse threading. The threading on the threaded rod 705 moves such that the threading starts at the ends of the rods and moves towards the center of the threaded rod 705. The threaded rod is connected to the turn knob 703.

The turn knob 703 will allow the users to turn the threaded rod 705 by turning the turn knob 703. The threaded rod is further connected to a compression device. In the shown embodiment the compression device is comprised of scissoring lift 706. The scissoring lift is comprised of two scissor sides connected by a pivot 708. The scissoring lift 706 will attach to the threaded rod 705 via threaded apertures 707 located at the lower ends of each side of the scissoring lift 706. The upper ends of the scissoring lift 706 have connectors 709 located thereon. In one embodiment the connectors 709 are hooks.

The connectors 709 of the scissoring lift 706 will attached to a cartridge compression plate 710. The cartridge compression plate 710 has a plurality of apertures 711 located on a bottom side thereof. In one embodiment the apertures 711 are elongated apertures. This will allow the connectors 709 from the scissoring lift 706 to move side to side as the scissor lift 706 moves.

The cartridge compression plate 710 has a connection prong 712. The connection prong 712 will attach to a cartridge connection plate 713. The cartridge connection plate 713 has a protrusion 714 located on the underside of the cartridge connection plate 713. The protrusion 714 has an aperture 715 location therein. The connection prong 712 will secure within the aperture 715 holding the cartridge compression plate 710 to the cartridge connection plate 713.

The cartridge connection plate 713 creates the bottom of a cartridge 716. In one embodiment the cartridge 716 is made from plastic. In another embodiment the cartridge 716 is made from paper products. In one embodiment the cartridge 716 is dissolvable in an aqueous media. In one embodiment the cartridge 716 has an accordion design. This will allow the cartridge 716 to fold down as compressed. In some embodiments the cartridge 716 has an upper protrusion 716*a*. The upper protrusion 716*a* will connect to the solution chamber 801 and the roller ball 603 as described in FIG. 10.

Figure 9:
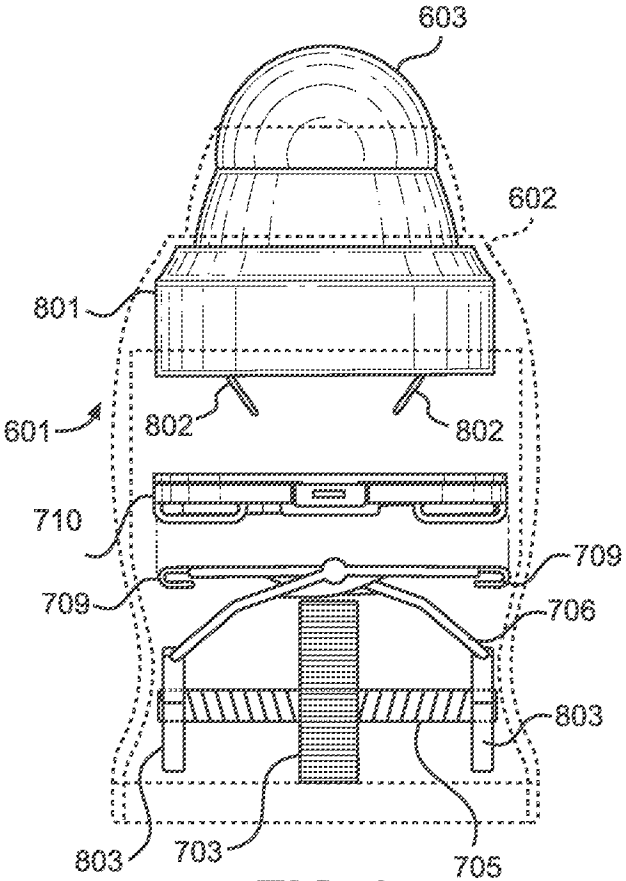
FIG. 9 shows a cross-sectional view of an alternate embodiment of the repeatedly refillable reusable dispenser having a roll-on applicator.

Referring now to FIG. 9, there is shown cross-sectional view of an alternate embodiment of the repeatedly refillable reusable dispenser having a roll-on applicator. The upper section 602 of the housing 601 has a solution chamber 801 located therein. The solution chamber 801 connects to the top side of a cartridge. In one embodiment the solution chamber 801 will connect to the protrusion of the cartridge. The solution from the cartridge will enter the solution chamber 801 and contact the roller ball 603.

The solution chamber 801 has an upper side that is configured to accept a portion of the roller ball 603. The roller ball 603 will have the ability to float slightly between the solution chamber 801 and the opening in the upper section 602. The solution chamber 801 along with the proportions of the opening of the upper section 602 the roller ball 603 will be held within the dispenser. This will prevent the roller ball 603 from becoming lost.

In some embodiments the solution chamber 801 has a cartridge opening device 802. In this embodiment when the cartridge is connected the device will puncture the cartridge allowing solution to exit the cartridge. In one embodiment the cartridge opening device 802 is a blade. In another embodiment the cartridge opening device 802 is a poker.

In this view the components of the dispensing device can be seen within the housing 601. The turn knob 703 is located within the aperture of the housing 601. The turn knob 703 is secured to the threaded rod 705. The scissor lift 706 is connected at one end to the threaded rod 705. The connectors 709 of the scissor lift 706 are connected to the cartridge compression plate 710. In the shown embodiment there are additional support braces 803 connected to the threaded apertures 707 of the scissor lift. The support braces 803 will contact the base 601*a* of the housing 601. This will wake pressure off of the threaded rod 705 and place the pressure on the base 601*a*.

Figure 10:
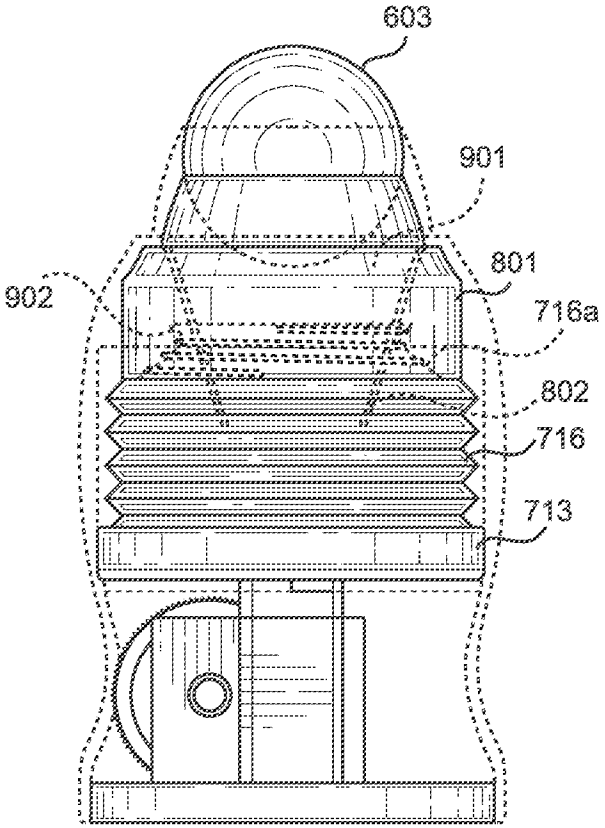
FIG. 10 shows a cross-sectional view of an alternate embodiment of the repeatedly refillable reusable dispenser having a roll-on applicator.

Referring now to FIG. 10, there is shown cross-sectional view of an alternate embodiment of the repeatedly refillable reusable dispenser having a roll-on applicator. In this view there is a solution cartridge 716 placed within the dispenser. The solution cartridge 716 is secured to the cartridge compression plate 710 via the cartridge connection plate 713. The upper end of the cartridge 716 is connected to the solution camber 801. A solution 901 can be seen filling the cartridge 716 and the solution chamber 801. The solution is then spread along the roller ball 603.

The turn knob 703 is used to activate the dispensing device. In one embodiment the dispensing device is used to apply pressure to the contents of the cartridge 716. This will force solution in to the solution chamber 801 and onto the ball. In other embodiments the dispensing device is used to slowly compress the cartridge gradually releasing solution. In one embodiment the dispensing device will over compress the cartridge 716 which will ensure that all of the contents of the cartridge is dispelled.

In the shown embodiment the cartridge has an upper protrusion 716*a* that will enter the solution chamber 801. The upper protrusion is configured to fit around the opening device 802. The opening device 802 will open the cartridge 713. The upper protrusion 716*a* has a plurality of threads 902 location on one side thereof. There interior if the solution chamber 801 will have a matching set of threading. This will allow the cartridge 713 to be threaded into the solution chamber 801.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refillable roll-on dispenser, the dispenser comprising:

A housing, having a base, an open top end and an interior volume;

The interior of the housing contains a dispensing device coupled to the base of the housing;

The dispensing device includes a compression device which is coupled to a cartridge compression plate;

The opened top end of the housing has an upper section removably secured thereto, wherein the upper section houses a roller ball therein.

2. The refillable roll-on dispenser of claim 1, further comprising:

an aperture located in a lower part of the housing;

the aperture further comprising a turn wheel protruding therethrough; and wherein the turn wheel is connected to the dispensing device.

3. The refillable roll-on dispenser of claim 1, wherein the upper section is removably secured to the housing via a threaded attachment.

4. The refillable roll-on dispenser of claim 1, further comprising a lid member; wherein the lid member is configured to be removably coupled to the housing over the upper section.

5. The refillable roll-on dispenser of claim 4, wherein the lid member creates a seal with the housing.

6. The refillable roll-on dispenser of claim 1, further comprising a replaceable cartridge removably affixed to the cartridge compression plate.

7. The refillable roll-on dispenser of claim 6, wherein the cartridge is dissolvable in an aqueous media.

8. The refillable roll-on dispenser of claim 6, wherein the cartridge is plastic.

9. The refillable roll-on dispenser of claim 6, wherein the cartridge has a plurality of peaks and valleys forming an accordion shape along the sides of the cartridge.

10. The refillable roll-on dispenser of claim 1, wherein the dispensing device is comprised of a threaded rod; wherein the compression device comprises a scissor device and the threaded rod is connected to one end of the scissor device.

11. The refillable roll-on dispenser of claim 10, wherein the scissor device further includes a bracing member attached to a lower side of the scissor device, wherein the bracing member contacts the base of the housing providing support to the scissor device.

12. The refillable roll-on dispenser of claim 10, wherein a second end of the scissor device is coupled to an underside of the cartridge compression plate.

13. The refillable roll-on dispenser of claim 12, wherein scissor device is coupled to the underside of the cartridge compression plate.

14. The refillable roll-on dispenser of claim 1, further comprising a solution chamber, wherein the solution chamber fits within the upper section of the housing.

15. The refillable roll-on dispenser of claim 14, wherein the roller ball fits between an opening of the upper section and the solution chamber.

16. The refillable roll-on dispenser of claim 15, wherein the roller ball partially protrudes through the opening in the upper section.

17. The refillable roll-on dispenser of claim 14, further comprising a cartridge having a top protrusion that has a plurality of threads located on a lower interior side thereof.

18. The refillable roll-on dispenser of claim 17, wherein the cartridge top protrusion is secured to the solution chamber via the plurality of threads.

19. The refillable roll-on dispenser of claim 17, wherein the solution chamber further comprises a cartridge puncturing device, wherein the cartridge puncturing device will puncture the cartridge when the cartridge is placed in the solution chamber.

20. The refillable roll-on dispenser of claim 17, the further comprising a turn wheel which latches in place upon total compression of the cartridge.

* * * * *